United States Patent [19]

Stehouwer

[11] Patent Number: 5,076,011

[45] Date of Patent: Dec. 31, 1991

[54] SEAMED POT COVER

[75] Inventor: William J. Stehouwer, Lansing, Mich.

[73] Assignee: The John Henry Company, Lansing, Mich.

[21] Appl. No.: 385,286

[22] Filed: Jul. 25, 1989

[51] Int. Cl.[5] ..... A01G 9/02

[52] U.S. Cl. ..... 47/72; 220/678; 229/1.5 B

[58] Field of Search ..... 229/87.01, 1.5 B, 1-2; 220/62, 678, 679; 383/107, 108, 122, 907; 206/423; 47/72

[56] References Cited

U.S. PATENT DOCUMENTS

| | | | |
|---|---|---|---|
| 681,066 | 8/1901 | Millingar | 206/423 X |
| 1,025,606 | 5/1912 | Bayless | 229/1.5 B |
| 3,683,938 | 8/1972 | Rowland | 229/1.5 B |

FOREIGN PATENT DOCUMENTS

| | | | |
|---|---|---|---|
| 2501691 | 7/1976 | Fed. Rep. of Germany | 206/423 |
| 2489126 | 8/1980 | France | 47/72 |
| 2603159 | 3/1988 | France | 47/72 |
| 2633591 | 1/1990 | France | 206/423 |
| 1360801 | 7/1974 | United Kingdom | 220/677 |
| 2074542 | 11/1981 | United Kingdom | 206/423 |

*Primary Examiner*—Henry E. Raduazo

*Attorney, Agent, or Firm*—Price, Heneveld, Cooper, Dewitt & Litton

[57] ABSTRACT

A seamed decorative pot cover article and a method of manufacturing the article. The pot cover includes a plurality of side panels extending upwardly from a base and flaring outwardly away from the base. The panels are seamed together at their edges and are symmetrical about the seams. The seams are separated into straight segments having different angles with the base such that upper portions of the panels flare to a greater extent. The article is manufactured by forming a plurality of butt welds in a sheet of stock extending outwardly from a central portion to the edge and trimming excess material outwardly of the butt welds.

11 Claims, 2 Drawing Sheets

SEAMED POT COVER

BACKGROUND OF THE INVENTION

This invention relates to a decorative article and method of manufacturing such article. This invention is especially adapted to a decorative cover for flowerpots. More particularly, the invention concerns a decorative pot cover that may be inexpensively manufactured and compactly shipped in large quantities to distributors in the floral industry.

There has long existed the desire to cover flowerpots with a decorative wrapping to not only hide the functionally appearing flowerpot but also to complement the beauty of the flowers or plant in the pot. Traditionally, such cover is provided as a sheet of decorated foil, hand-molded by the florist to the contour of the pot and complemented by a ribbon or the like. It was soon discovered that by using various polymeric materials, such as polyethylene and polypropylene, which tend to return to their original shape after distortion, and various manufacturing techniques, pot covers could be manufactured in a factory and shipped in bulk quantities. At the point of use, the flowerpot is dropped into the pot cover. Because of the nature of the materials used, any distortion of the cover's shape during shipping would not cause permanent deformation in the covers. An example of such manufactured pot cover is disclosed in U.S. Pat. No. 2,355,559, issued to Renner for COVER FOR CONTAINERS. In the Renner disclosure, randomly-located plicated portions, or overlapping folds, are heat-sealed in place to impart a self-sustaining nature to the pot cover made from a sheet of non-self-sustaining material. By virtue of its manufacture from a single sheet of material that is formed but not otherwise disturbed, the Renner pot cover is impervious to water that may spill from the flowerpot.

One limitation of prior pot covers is that the plicated portions are randomly oriented, which presents a casual, cluttered appearance to the product. Importantly, the random structure limits the pattern that can be used on the sheet stock, from which the pot cover is manufactured, to a relatively small pattern that will be randomly distributed along the plicated portions. This further contributes to the cluttered appearance of the pot cover.

SUMMARY OF THE INVENTION

The purpose of the present invention is to provide a low-cost pot cover that is impervious to liquids, such as water, but which has many important features not possessed by prior pot covers. Specifically, the present invention provides a pot cover that has an elegant, formal appearance with graceful lines that flow in an uninterrupted fashion. The present invention importantly provides, for the first time in such manufactured pot covers, the ability to register a large pattern figure printed on the sheet stock with a specific structure on the pot cover to create unique designs not previously possible.

A pot cover, according to the invention, includes a substantially planar base and a plurality of side panels extending upwardly from the base and terminating in an edge surrounding an upper opening in the cover. Each of the side panels increases linearly in width such that the pot cover flares outwardly away from the base and each of the panels is symmetrical with adjacent panels on both sides. In one form, the pot cover is manufactured from a rectilinear sheet stock, such as a square sheet stock, such that, although symmetrical with adjacent side panels, each side panel is asymmetric about its median vertical axes. In another form, the panels increase linearly in width away from the base at a first ratio adjacent the base and at a second, greater ratio, adjacent the upper opening such that the pot cover flares slightly outwardly adjacent the base to hold the flowerpot and flares outwardly away from the base to a greater extent at the upper portion in order to impart simple, yet interesting lines to the article.

A method of manufacturing pot covers according to the invention includes the steps of providing a sheet of stock having edge means defining a perimeter edge thereof, forming a plurality of butt welds in the sheet extending from a central portion of the sheet outwardly to its perimeter edge and trimming excess material outwardly of the butt welds. By making the butt welds impervious to liquid, the pot cover may be made water-retaining notwithstanding the cutting away of portions of the material.

These and other related objects, advantages and features of this invention will become apparent upon review of the following specification in conjunction with the drawings.

DESCRIPTION OF THE PREFERRED EMBODIMENT

Figure 1:
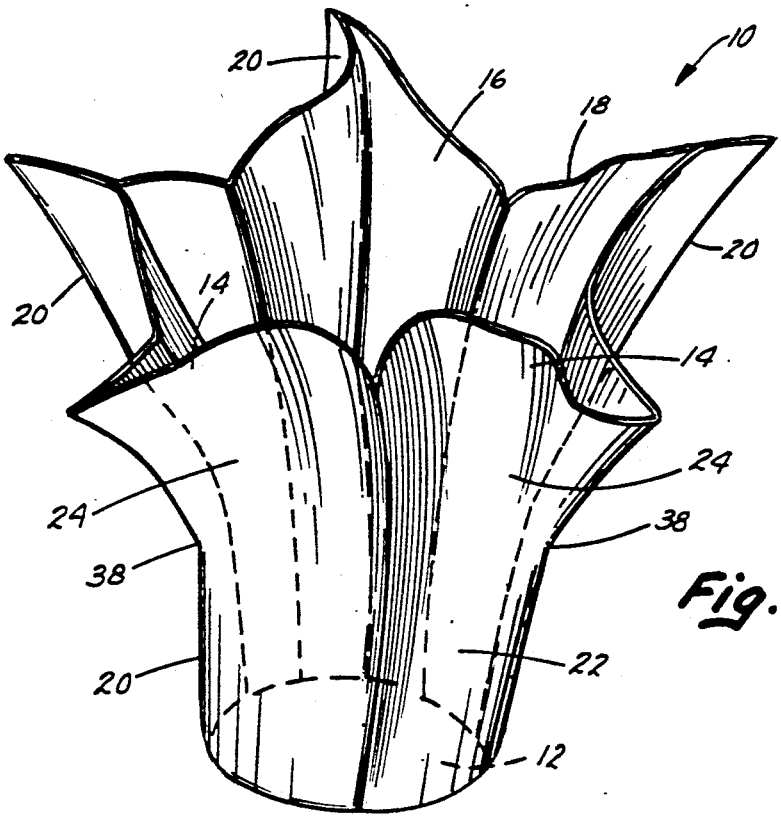
FIG. 1 is a perspective view taken from the top and a side of a cover according to the present invention.

Referring now specifically to the drawings, and the illustrated embodiments depicted therein, a decorative flowerpot cover 10 includes a generally circular, planar base 12 and a plurality of side panels 14 extending upwardly from the base. Panels 14 terminate in an upper opening 16 defined by a perimeter edge 18. Adjacent panels 14 are joined at their common edge by a seam 20 which, in the illustrative embodiment, is a butt weld.

Each panel 14 includes a generally planar lower panel portion 22 that flares outwardly away from base 12 and a generally planar upper panel portion 24 which flares outwardly away from panel 22 at a greater angle with respect to the perpendicular of base 12 than does lower panel portion 22. In use, the flowerpot is inserted through opening 16 and will nest within lower panel portions 22. Upper panel portions 24 will flare dramatically outwardly generally above the upper rim of the flowerpot.

Figure 2:
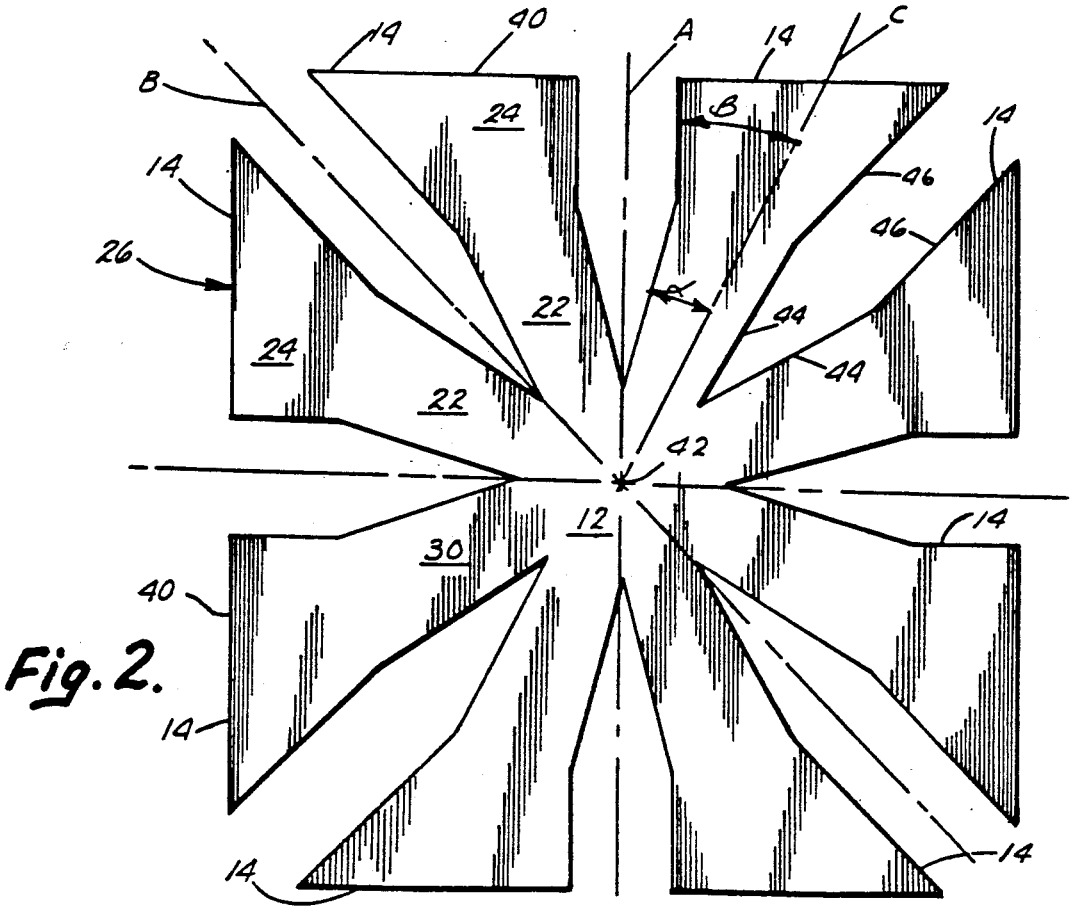
FIG. 2 is a disassembled pot cover illustrating the location of the seams and the material removed from the sheet stock during the manufacture of the pot cover.
Figure 3:
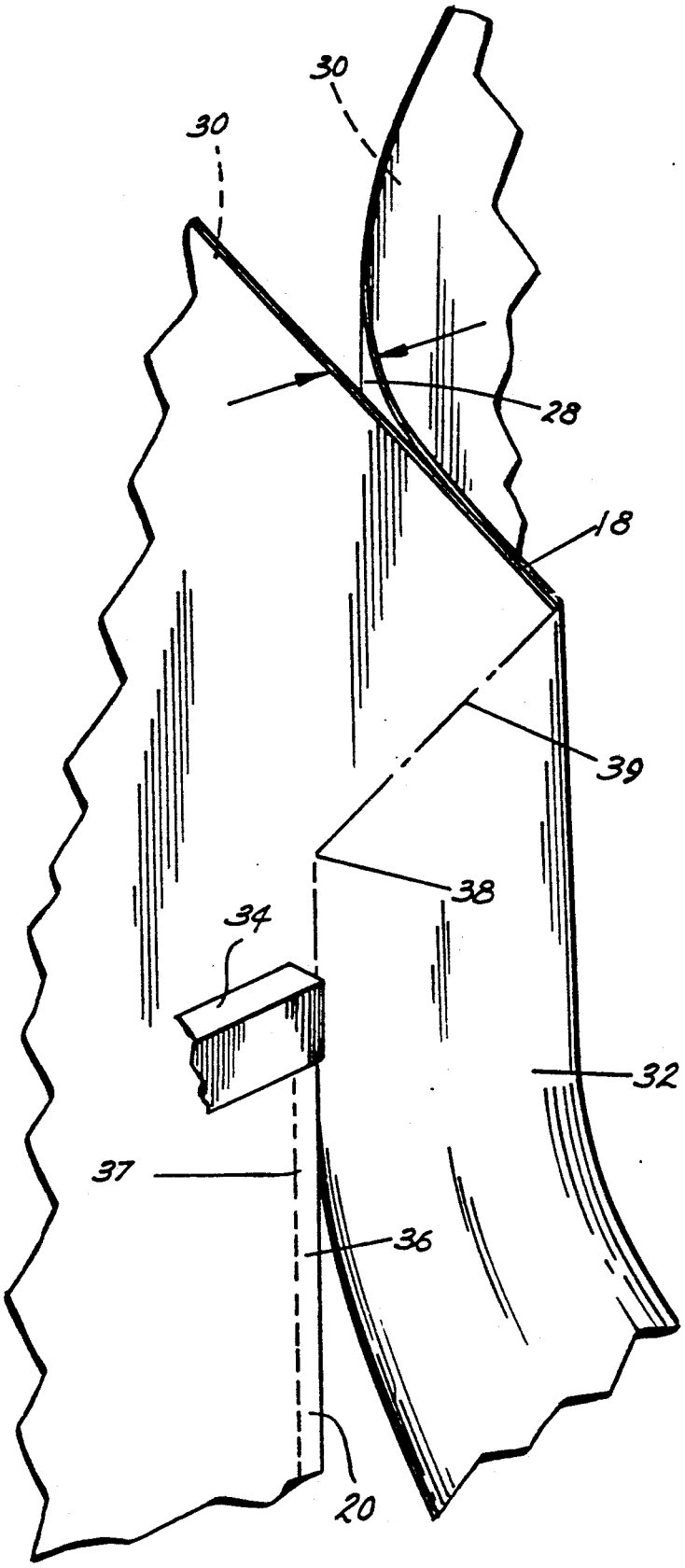
FIG. 3 is an illustration of the method according to the invention.

The flowerpot cover 10 is manufactured from a single sheet of stock 26 which, in the illustrative embodiment, is a rectilinear form, such as a square (FIG. 2). As illustrated in FIG. 3, each seam 20, which extends from base 12 to perimeter edge 18, is formed by gathering at 28 adjacent portions of one surface 30 of stock 26. A butt weld 36 is formed as by heat-sealing and excess material 32 is simultaneously trimmed by the use of a heated head 34. Such technique produces a liquid-impervious butt weld 36. Such simultaneous heat-sealing and trimming procedures are well-known in the art of plastic working and include applying pulsed electrical current through a wire electrode (not shown) to which is attached a heat-distributing plate (not shown) configured to the width and length of seam 20. This plate distributes heat from the wire electrode to the sheet stock 26 to form the butt weld 36 and simultaneously sever material 30 that is located outwardly of seam 20 from the remaining portion of the pot cover. In the illustrated embodiment, head 34 is constructed of such electrode wire and heat distribution plate which are raised to a temperature of 240° F. (plus or minus 10° F.) by applying a squarewave having a pulse repetition rate of 60 Hz at a voltage of 120 volts through the wire electrode.

In a preferred embodiment, head 34 is elongated and extends the full length from base 12 to edge 18, in order to form an entire weld 36 all at once without movement along the surface of the stock. In a most preferred embodiment, all seams 20 are formed simultaneously. Additionally, head 24 presses stock 26 against a backing member (not shown) made from heat-resistant foam that is covered with a Teflon coating.

Referring to FIG. 3, weld 36 has a lower straight portion 37 extending in a straight line from base 12 outwardly at a small angle with the perpendicular of the base to a knee portion 38. Weld 36 includes a second straight portion 39 extending from knee 38 to perimeter edge 18 at a larger angle with the perpendicular of the base. As may be seen by reference to FIG. 2, the above-described process results in a pot cover having panels 14 that include lower panel portions 22 which flare outwardly at a first predetermined angle with a perpendicular of base 12 and upper panel portions 24 which flare outwardly at a second predetermined angle with a perpendicular of base 12. The angle of flare of panel portion 24 is larger than that of panel portion 22. In addition, panels 14 are symmetric with adjacent panels 14 about a plane A or B upon which seams 20 are located and which are viewed on end in FIG. 2. Plane A extends parallel the edge portions 40 of stock 26 through the center 42 of the stock and plane B extends diagonally from the corners of stock 26 through center 42. It may additionally be seen that panels 14 are not themselves symmetrical, i.e., they are asymmetric about their vertical median plane C which is also viewed on end in FIG. 2. The result is that perimeter edge 18 has an undulating appearance that gracefully flows around the perimeter of the floral arrangement, as best seen in FIG. 1. The width of panel portion 22 increases linearly away from base 12 forming an angle $\alpha$ between edges 44 of lower panel portion 22 and plane C. The width of panel portion 24 increases linearly away from base 12 at a greater rate forming an angle $\beta$ between edges 46 of upper panel portion 24 and plane C. Because $\beta$ is larger than $\alpha$, panels 14 become more flared outwardly at an upper portion adjacent opening 16 than at a lower portion surrounding the flowerpot (not shown). In the illustrated embodiment, angles $\alpha$ and $\beta$ are approximately 28° and 32°, respectively.

In the illustrated embodiment, flowerpot cover 10 is made from a square sheet that is 0.003" thick polyethylene or polypropylene. Although the method is illustrated using a heat-sealing butt weld, other techniques, such as sonic welding or adhesive joining may also be used. Additionally, although the welding and trimming steps are illustrated as occurring simultaneously, the trimming could be performed prior to or subsequent to the welding step.

The gathering and seaming of the sheet stock imparts a self-sustaining structure to the pot cover notwithstanding the relatively flexible nature of the thin polymeric material from which it is made. As can be seen by reference to FIG. 2, the predetermined location of each panel portion 22, 24 with respect to sheet stock 26 allows registry of the panel portions with a pattern (not shown) on the stock in a manner that facilitates selective positioning of the pattern on the panel portions. Thus, even large patterns may be creatively applied to the pot cover according to the invention. Changes and modifications in the specifically described embodiments can be carried out without departing from the principles of the invention which is intended to be limited only by the scope of the appended claims, as interpreted according to the principles of patent law, including the doctrine of equivalents.

The embodiments of the invention in which an exclusive property or privilege is claimed are defined as follows.

1. A pot cover comprising:

a substantially planar base;

a plurality of side panels extending upwardly from said base and terminating in an edge means defining an upper opening in said cover;

adjacent ones of said side panels being joined at lateral edges by seams extending from said base to said edge means;

each of said side panels increasing linearly in width away from said base such that said pot cover flares outwardly away from said base;

each of said side panels being symmetrical with the adjacent ones of said side panels; and each of said panels being asymmetric about a median vertical plane of the pixel extending between said base and said edge means.

2. A pot cover comprising:

a substantially planar base;

a plurality of side panels extending upwardly from said base and terminating in an edge means defining an upper opening in said cover;

adjacent ones of said panels being joined at lateral edges by seams extending from said base to said edge means;

each of said side panels increasing linearly in width away from said base such that said pot cover flares outwardly away from said base;

each of said side panels being symmetrical with the adjacent ones of said side panels; and each of said side panels increasing linearly in width away from said base at a first ratio adjacent said base and at a second ratio adjacent said upper opening, said second ratio being greater than said first ratio such that said pot cover flares outwardly away from said base to a greater extent at an upper portion thereof.

3. The pot cover in claim 2 in which said butt welds are impervious to liquids.

4. A pot cover manufactured from a sheet of stock as defined in claim 6 in which said seams are formed by welding spaced-apart portions of said stock and trimming the excess material outwardly of said seams.

5. A pot cover manufactured form a sheet of stock as defined in claim 6 in which said seams are formed by butt welding spaced-apart portions of said stock and trimming the excess material outwardly of said seams.

6. The pot cover in claim 2 in which said seams are impervious to liquid.

7. The pot cover in claim 6 wherein said pot cover is made of 0.003 inch thick polymeric material.

8. A pot cover manufactured from a sheet of stock comprising:

a generally planar base portion;

a sidewall extending upwardly from said base and defining a continuous surface;

said sidewall divided into sidewall panels by seams interconnecting adjacent panels;

each of said panels being symmetrical with each adjacent one of said panels about an axis generally defined by the joining one of said seams;

each of said seams having a substantially consistent cross section along its length;

said panels flaring outwardly away from said base at a first predetermined angle with the perpendicular of said base adjacent said base and at a second predetermined angle with the perpendicular of said base beyond a predetermined distance from said base, said second predetermined angle being greater than said first predetermined angle.

9. A pot cover manufactured from a sheet of stock comprising:

a generally planar base portion;

a sidewall extending upwardly from said base and defining a continuous surface;

said sidewall divided into sidewall panels by seams interconnecting adjacent panels;

each of said panels being symmetrical with each adjacent one of said panels about an axis generally defined by the joining one of said seams;

each of said seams having a substantially consistent cross section along its length; and each of said panels being asymmetrical about a median vertical plane of the panel.

10. A pot cover manufactured from a sheet of stock according to a process including the steps of:

forming a plurality of butt welds in said stock from a central portion of said stock outwardly to a peripheral edge of said stock;

said butt welds defining therebetween planar side panels being defined between said butt welds from said central portion of said peripheral edge, said side panels flaring outwardly away from said central portion, said planar side panels including two generally flat planar portions angularly related to each other and to said central portion such that the one of said planar portions adjacent said peripheral edge has an angle with the perpendicular of said central portion that is larger than the angle of said planar portions adjacent said central portion with the perpendicular of said central portion; and trimming excess material outwardly of said butt welds.

11. The pot cover in claim 10 in which said side panels extend from said central portion in a manner that said central portion is substantially circular.

* * * * *

UNITED STATES PATENT AND TRADEMARK OFFICE

CERTIFICATE OF CORRECTION

PATENT NO. : 5,076,011

DATED : December 31, 1991

INVENTOR(S) : William J. Stehouwer

It is certified that error appears in the above-identified patent and that said Letters Patent is hereby corrected as shown below:

Column 2, line 29:
After "of a" insert --pot--.

Column 2, line 30:
"is a" should be --shows a--.

Column 4, line 36, claim 1:
Delete "said".

Column 4, line 35, claim 1:
"pixel" should be --panel--.

Column 4, line 60, claim 4:
"claim 6" should be --claim 2--.

Column 4, line 63, claim 5:
"form" should be --from--.

Column 4, line 64, claim 5:
"claim 6" should be --claim 2--.

UNITED STATES PATENT AND TRADEMARK OFFICE

CERTIFICATE OF CORRECTION

PATENT NO. : 5,076,011

DATED : December 31, 1991

INVENTOR(S) : William J. Stehouwer

It is certified that error appears in the above-identified patent and that said Letters Patent is hereby corrected as shown below:

Column 6, line 15, claim 10, "of said" should be --to said--.

Signed and Sealed this

Seventeenth Day of August, 1993

*Attest:*

*Attesting Officer*

BRUCE LEHMAN

*Commissioner of Patents and Trademarks*